US006885178B2

(12) United States Patent
Marinca

(10) Patent No.: US 6,885,178 B2
(45) Date of Patent: Apr. 26, 2005

(54) CMOS VOLTAGE BANDGAP REFERENCE WITH IMPROVED HEADROOM

(75) Inventor: Stefan Marinca, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 10/330,379

(22) Filed: Dec. 27, 2002

(65) Prior Publication Data

US 2004/0124825 A1 Jul. 1, 2004

(51) Int. Cl.[7] ..... G05F 3/16
(52) U.S. Cl. ..... 323/316; 327/542
(58) Field of Search ..... 323/313, 314, 323/315, 316, 280, 281; 327/539, 540, 541, 542, 543

(56) References Cited

U.S. PATENT DOCUMENTS 6,307,426 B1 * 10/2001 Ricotti et al. ..... 327/543
6,489,835 B1 12/2002 Yu et al.
6,529,066 B1 * 3/2003 Guenot et al. ..... 327/539

OTHER PUBLICATIONS

International Search Report from corresponding International Application No. PCT/US03/41254 filed Dec. 24, 2003.
Brokaw, A.P., "A simple three–terminal IC bandgap reference", IEEE Journal of Solid–State Circuits, vol. SC–9, No. 6, Dec. 1974, pp. 388–393. (copy as is –sent with search report).
Ka Nag Leung et al., A sub–1–V 15–ppm/degrees C Cmos bandgap voltage reference without requiring low threshold voltage device, IEEE Journal of Solid–State Circuits, vol. 37, No. 4, Apr. 2002 pp. 526–530. XP002286296.
Timothy Lo and K. Phang, *Low Voltage Low Power CMOS Bandgap References*, University of Toronto, Dec. 21, 2001.

* cited by examiner

*Primary Examiner*—Jessica Han
(74) *Attorney, Agent, or Firm*—Wolf, Greenfield & Sacks, P.C.

(57) ABSTRACT

A voltage bandgap reference voltage circuit is provided. The circuit includes an amplifier having a first and second transistor coupled to the inputs of the amplifier. The circuit is adapted to operate with lower headroom by effecting a subtraction of a voltage substantially equivalent to Delta Vbe of the first and second transistors from the voltage applied to the common input of the amplifier.

12 Claims, 7 Drawing Sheets

CM OS VOLTAGE BANDGAP REFERENCE WITH IMPROVED HEADROOM

FIELD OF THE INVENTION

The invention relates to voltage bandgap reference circuits and in particular to a voltage bandgap reference circuit with improved headroom capabilities. Within the present specification the term "headroom" is defined as a difference between the power supply voltage for the circuit and the reference voltage provided by the circuit.

BACKGROUND TO THE INVENTION

Bandgap voltage reference circuits are well known in the art from the early 1970's as is evidenced by the IEEE publications of Robert Widlar (IEEE Journal of Solid State Circuits Vol. SC-6 No 1 Feb. 1971) and A. Paul Brokaw (IEEE Journal of Solid State Circuits Vol. SC-9 No 6 Dec. 1974).

These circuits implement configurations for the realization of a stabilized bandgap voltage. As discussed in David A. Johns and Ken Martin "Analog Integrated Circuit Design", John Wiley & Sons, 1997, these circuits and other modifications to same are based on subtracting the voltage of a forward based diode (or base emitter junction) having a negative temperature coefficient from a voltage proportional to absolute temperature (PTAT). Typically, the PTAT voltage is formed by amplifying the voltage difference ($\Delta V_{be}$) of two forward biased base-emitter junctions operating at different current densities.

An example of such a circuit is shown in schematic form in FIG. 1. In this Figure a bandgap voltage reference circuit is implemented using an operational amplifier A, three resistors, P1, P2 and R3, and two parasitic transistors, Q1 and Q2, with Q2 having an emitter area n times larger than Q1. The output of the amplifier A is coupled to its inverting terminal via the feedback resistor R3. The output of A is also coupled to the emitter of transistor Q1 via the resistor R1, with the base of Q1 being tied to ground. The inverting terminal of A is coupled to the emitter of Q2 via the resistor R2, with the base of Q2 also tied to ground. The non-inverting terminal of A is coupled to the emitter of Q1.

It is well known that the difference in base-emitter voltages of two bipolar transistors operating at different collector current densities is proportional to absolute temperature. In FIG. 1 making the emitter area of Q2 "n" times larger than emitter area of Q1 ensures the difference in collector current densities. As the amplifier A keeps the two inputs, noninverting, (+) and inverting, (−), substantially at the same voltage level the voltage developed across R2 is:

$$\Delta V_{BE}=(kT/q)\ln(nI_1/I_2) \quad (1)$$

It is known and can be shown quite easily that the reference voltage is equal to $\Delta V_{BE}$ multiplied by a factor of K and added to the base emitter voltage of the junction with the larger current density, as is shown in Equation 2

$$V_{ref}=V_{BE1}+K\Delta V_{BE}, \quad (2)$$

For the circuit of FIG. 1 the reference voltage is:

$$V_{ref}=V_{BE1}+(R3/R2)kT/q(\ln(nR3/R1) \quad (3).$$

This equation, it will be understood can be used to determine the theoretical reference voltage for specific situations and implementations.

In other implementations current mirrors may replace the resistors R1 and R3 of FIG. 1. FIG. 2 shows an example of such a modification. The circuit of FIG. 2 is similar to that of FIG. 1, with the same components being given the same reference numerals. In the circuit of FIG. 2, the non-inverting terminal of the operational amplifier A is connected to the emitter of Q2 via the resistor R2. The inverting terminal is connected to the emitter of Q1. The base of both Q1 and Q2 are connected to ground. The output of A is coupled to the gates of PMOS devices M1 and M2, rather than the resistors R1 and R3 of FIG. 1. The source terminals of M1 and M2 must then be connected to the power supply, referenced in the figure as VDD. The drain of M2 is connected to the non-inverting terminal of amplifier A.

One important specification of any bandgap voltage reference is minimum supply voltage. As is well known, if the amplifier A (FIG. 1 and FIG. 2) has a differential stage which uses a pair of PMOS transistors, the common input voltage (the term "common input voltage" being used herein synonymously with "common mode input voltage" and "input common mode voltage") is lower as compared to that provided by an NMOS input pair. However, a differential pair of PMOS transistors is preferred due to noise consideration. For the case of a PMOS input pair the threshold voltage of the PMOS transistors and the input common mode voltage of the amplifier determine the minimum supply voltage. As the threshold voltage for a specific process is given, the only way to reduce minimum supply voltage is to reduce the common input voltage of the amplifier, i.e. the base-emitter voltage for the circuits of FIG. 1 and FIG. 2.

Methods of resistive subdivision are well known such as those described in Fa Nang Leung et al., "*A sub-1-V 15-ppm, C CMOS Bandgap Voltage Reference Without Requiring Low Threshold Voltage Device*", IEEE Journal Solid State Circuit, Vol.37/4, pp.526–530, April 2002. The basic configuration of these methods is shown in FIG. 3. The circuit of FIG. 3 has two resistor dividers, one connected to each or the input terminals of the amplifier A. Resistors R2B1 and R2B2 act as a resistor divider for the inverting terminal of amplifier A, with the voltage of the inverting terminal being taken between R2B1 and R2B2 as shown. Similarly, resistors R2A1 and R2A2 act as a resistor divider for the non-inverting terminal of amplifier A, with the voltage of the non-inverting terminal being taken between R2A1 and R2A1 as shown. In this circuit, the output of the amplifier A is connected to the gates of PMOS devices M1, M2 and M3, in the same manner as that of FIG. 2, with their sources being driven by the supply voltage VDD. The drain of M2 is connected to the emitter of Q1, and also to the resistor P2B1. The drain of M1 is connected both to the emitter of Q2 via resistor R1, and to resistor R2A1. The emitter area of Q2 is n times larger than Q1, as in the previous figures. The drain of M3 is coupled to ground via a resistor R3. The resistors R2A2 and R2B2 and the base of both Q1 and Q2 are all tied to the same reference potential, shown as ground in the schematic diagram of FIG. 3.

Using these configurations, the base-emitter voltage of the bipolar transistor operating at high current density (Q1) is subdivided by R2B1 and R2B2. The second bipolar transistor Q2 operating at low current density (Q2) and R1 generates a PTAT voltage across R1 if the ratio of second resistive divider, R2A1 and R2A2, is the same as the first resistive divider. One of the main disadvantages of this configuration is that the offset and noise of the amplifier A are amplified by the subdivision ratio. As a result, as the common voltage of the amplifier A reduces, the output offset and noise increases.

Another configuration allowing low voltage operating is described in U.S. Pat. No. 6,307,426 of Giulio Ricotti et al.

The basic idea of this configuration is to introduce an offset into the input bipolar differential stage of an amplifier. This offset voltage is a typical PTAT voltage. The reference voltage with low temperature coefficient is obtained by adding this PTAT voltage to a scaled CTAT voltage. The main drawbacks of this configuration are:

1) It can not be implemented in a CMOS process where only pure lateral transistors having all three terminals are available;
2) In a typical bipolar process there is also another unavoidable offset which is added to the PTAT offset voltage. As a result the real PTAT voltage and the output voltage may have a large spread from device to device and from lot to lot.

There is therefore a need to provide a circuitry that can provide a voltage bandgap reference signal, which can be implemented in CMOS technology and which provides for improved headroom over traditional circuitry.

There is also a need for a circuit that provides for reduced spread yet can be implemented in circuits with low availability of headroom.

SUMMARY OF THE INVENTION

These needs and others are provided by the circuitry of the present invention which by reducing the amplifier's input voltage and by changing one loop around the amplifier from positive to negative can provide a voltage reference able to operate at a lower supply voltage and which has reduced output spread or deviation from the desired output. By reducing the amplifier input voltage of the bandgap circuitry, the present invention provides for an improved power supply rejection ratio (PSRR) and an improved start up time than that which is conventionally available.

According to a first embodiment of the present invention an improved headroom bandgap reference voltage circuit is provided. The circuit comprises an operational amplifier having an inverting and a non-inverting input node and an output, the output coupled to a voltage reference node, and wherein the inverting and non-inverting input nodes are coupled to a first and a second transistor respectively, the transistors adapted so as to operate at different current densities. The common input node of the operational amplifier is provided by the base emitter voltage of the transistor operating at the lower current density, thereby effecting a reduction of the common input voltage of the operational amplifier so as to reduce the operational headroom of the circuit.

The voltage at the voltage reference node is typically a combination of PTAT and CTAT voltages. The CTAT voltage is desirably provided by the base-emitter voltage of a third transistor, coupled to the output Of the operational amplifier.

In a first configuration, the operational amplifier generates a PTAT current at its output, the PTAT current being converted to a PTAT voltage at the reference node by the provision of an impedance load coupled between the voltage reference node and ground. The output node of the operational amplifier may be coupled to at least one current mirror, the current mirror mirroring the PTAT current generated at the output of the operational amplifier, the current mirror provided between the output of the amplifier and the voltage reference node.

The common input node voltage of the operational amplifier is typically deriver from the difference in the base emitter voltages of the first and second transistors.

A resistor may be coupled between an input node of the operational amplifier and the transistor operating at the higher current density, thereby effecting a voltage difference between the base emitter voltages of the first and second transistors.

The common input node of the operational amplifier operates at a lower voltage by an amount which is typically substantially equal to the voltage difference between the first and second transistors produced across the resistor.

These and other features, objects and benefits of the present invention will be better understood with reference to the following drawings.

DETAILED DESCRIPTION OF THE DRAWINGS

In accordance with the present invention a bandgap voltage reference circuit is provided with improved headroom over the prior art and Which provides distinct advantages over prior art implementations.

Figure 4:
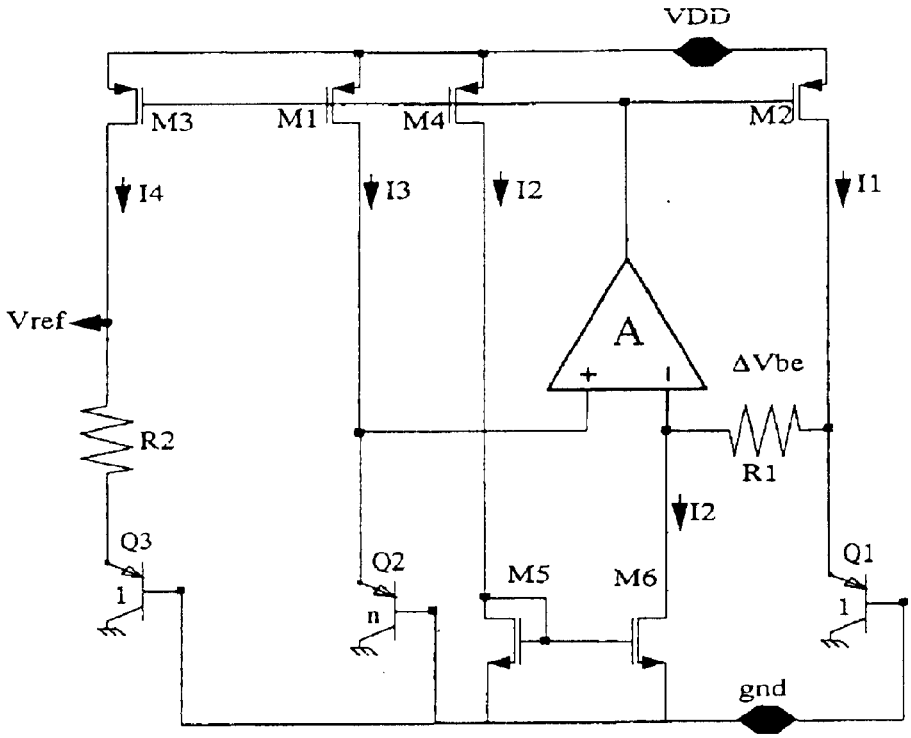
FIG. 4 is a schematic of a reference circuit according to a first embodiment of the present invention.
Figure 5:
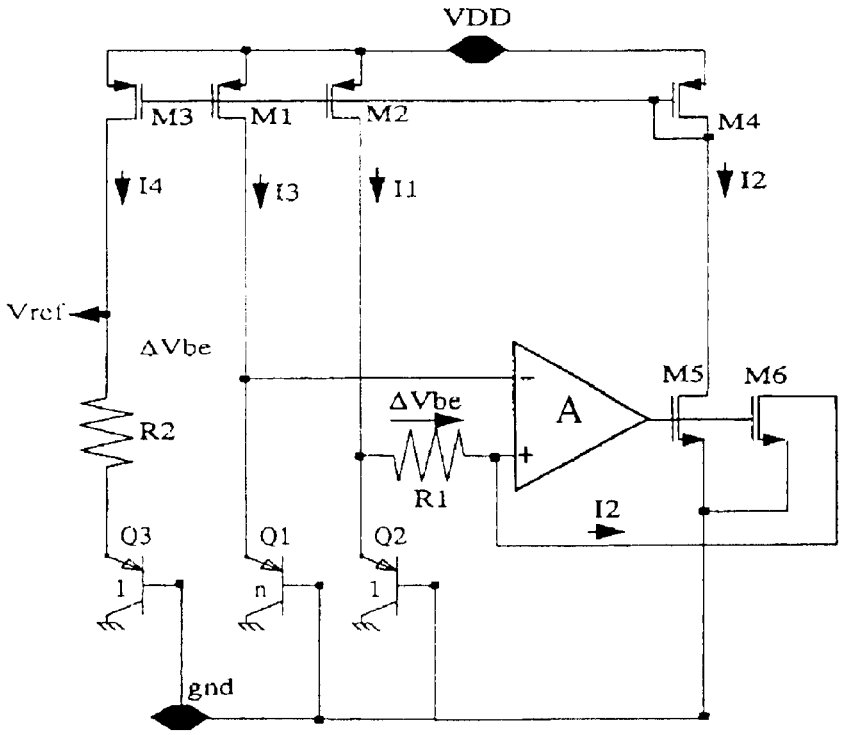
FIG. 5 is a schematic of a reference circuit according to a second embodiment of the present invention.
Figure 6:
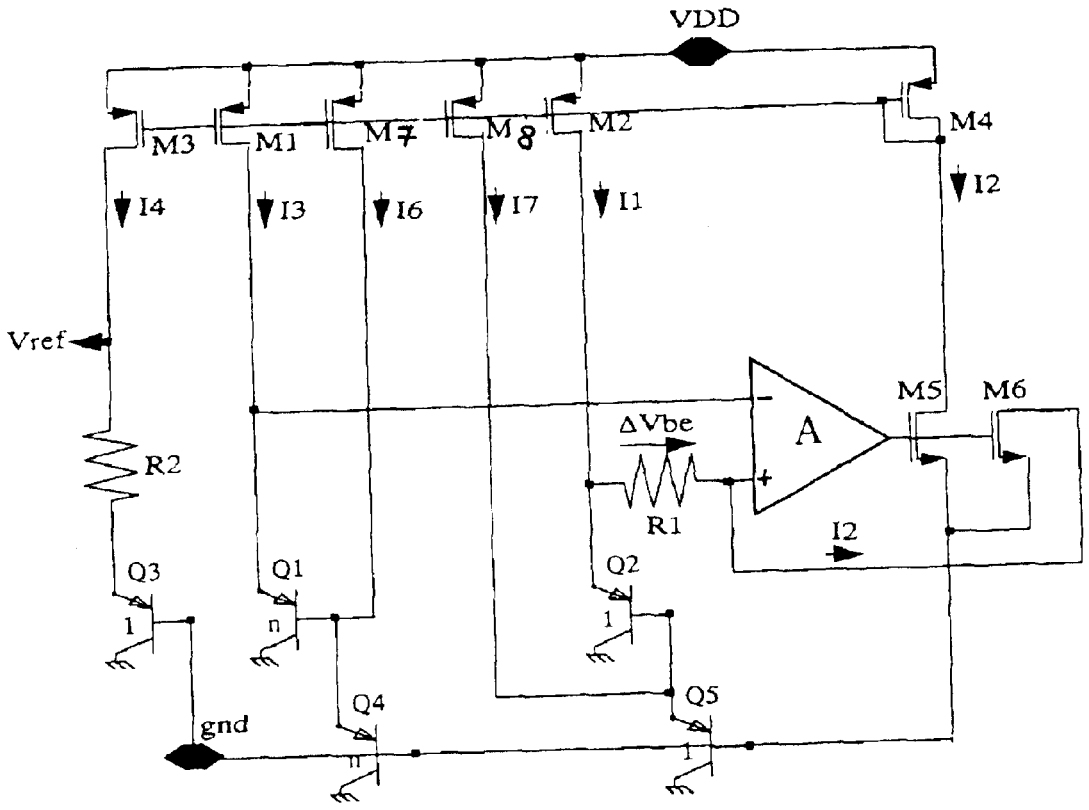
FIG. 6 is a schematic of a reference circuit in accordance with a third embodiment of the present invention.

As discussed previously in the section "Background to the Invention", known bandgap voltage reference circuits suffer from many disadvantages including spread over a large output value. As has been detailed previously there is therefore a need to provide an improved circuitry which addresses the needs of the prior art configurations. FIGS. 4 to 6 illustrate examples of solutions according to the present invention. It will be apparent to the person skilled in the art that although the invention will be described with reference to specific embodiments it will be understood that it is no intended to limit the present invention to any one set of combined integers except as may be deemed necessary in the light of the appended claims.

It will be understood from an examination of the circuits of FIGS. 4 to 6 that the present invention provides for the common input voltage of the amplifier generating a PTAT voltage to be no longer the base-emitter voltage of the transistor operating at the higher current density but rather the base-emitter voltage of the transistor operating at the lower current density. This is provided in preferred embodiments by a subtraction of the base-emitter voltage difference from the base-emitter voltage of the transistor operating at high current density. Comparing the implementations of the prior art to that of the present invention, it will be understood that for the same conditions the amplifier's input voltage of the embodiments of the invention are lower by a value of DeltaVbe as compared to that of the prior art configurations. This voltage difference provides a headroom gain for this circuit. It will be appreciated that the reduction of the input values to the amplifier, as provided by the circuitry of the present invention, may be provided in a number of different manners, and will now be described with reference to exemplary embodiments.

In FIG. 4 the output of an amplifier A is connected to the gates of PMOS devices M1, M2, M3 and M4, the sources of which devices are coupled to VDD. The drain of M1 is coupled to the emitter of Q2. The drain of M2 is coupled to the emitter of Q1. The drain of M3 is coupled to the emitter of Q3 via a resistor R2. The drain of M1 is coupled to the drain of a diode connected NMOS transistor M5. The non-inverting terminal of amplifier A is Coupled to the emitter of transistor Q2. The inverting terminal is coupled to the emitter of Q1 via a resistor R1, and also to the drain of an NMOS transistor M6. The gates of M5 and M6 are connected together, so as to form a current mirror. The bases of Q1, Q2 and Q3, and sources of M5 and M6 are all tied to a common reference potential, which is shown in FIG. 4 as ground, although it will be appreciated that any reference potential could be used.

The circuit of FIG. 4 operates as follows, After an initial settling time, the output of the amplifier A reaches a voltage level that pulls the common gate voltage of M1 to M4 thereby generating currents through these PMOS transistors to ensure the two inputs of the amplifier have the sale voltage, the base emitter voltage of the transistor operating at the lower current density. M1 forces a current I3 into the emitter of Q2; M2 forces a current I1 which is divided into I2 through R1 and M6 and another current into the emitter of Q1; M3 forces a current I4 through R2 into the emitter of Q3 and M4 forces a current I2 into the diode connected NMOS transistor M5. If M5 and M6 are the same then it will be understood that M6 pulls a current I2 through R1 from I1. The current I2 creates the necessary voltage drop across R1 in order to balance the amplifier A such that the two inputs, (+), (−), are at the same voltage level.

It will be understood that the voltage drop across R1 is:

$$\Delta V_{BE}=(kT/q)\ln(n(I_1-I_2)/I_3)=I_2R_1 \quad (4)$$

Eq.4 shows that $I_2$ and $I_1$, $I_3$ and $I_4$ are PTAT currents since they are generated from the same gate-source voltage. They differ only by a scaling factor corresponding to an aspect ratio (W/L).

The reference voltage is the base-emitter voltage of Q3 added to the voltage drop of I4 over R2:

$$V_{ref}=V_{BEQ3}+I_4R_2 \quad (5).$$

It will be appreciated the currents and $\Delta V_{BE}$ may be scaled as required. For example if:

$$I_1=I_4=2I_2=2I_3 \quad (6),$$

then the reference voltage can be calculated from:

$$V_{ref}=V_{BEQ3}+2R_2/R_1KT/q\ln(n) \quad (7,$$

Thus, it will be understood that a specific combination of resistor's ratio ($R_2/R_1$) and emitter ratio (n) will provide a reference voltage having a minimum temperature coefficient.

FIG. 5 shows an different embodiment of the present invention from that described in FIG. 4. The output of amplifier A in FIG. 5 is connected to the gates of NMOS devices M5 and M6. The drain of M6 is coupled back to the non-inverting terminal of A. The drain of M5 is connected to the drain of a diode connected transistor M4. The gate of M4 is connected to the gates of PMOS devices M1, M2 and M3, with the source terminals of all the PMOS devices being connected to VDD. The drain of M1 is connected to the emitter of transistor Q1, having an emitter area n times larger than transistors Q2 and Q3 of the circuit. The drain of M2 is connected to the emitter of transistor Q2. The drain of M3 is connected via a resistor R2 to the emitter of transistor Q3. In this Figure the non-inverting input of amplifier A is connected to the emitter of Q2 via a resistor R1, while the inverting terminal is connected to the emitter of Q1. The bases of Q1, Q2 and Q3, and the sources of M5 and M6 are all tied to ground potential.

The difference from FIG. 4 to FIG. 5 is how the PTAT current is mirrored. As was described with reference to FIG. 4, the amplifier A forces the common gate of $M_5$ and $M_6$ to a sufficient voltage level to ensure that a corresponding DeltaVbe voltage Is developed across $R_1$. The output current of $M_5$ is mirrored by the diode-connected transistor $M_4$ and repeated with the corresponding scale factor to $M_1$, $M_2$, $M_3$ and $M_6$.

The reference voltage for the circuit of FIG. 5 can be derived in the same way as it was for the circuit of FIG. 4.

Figure 1:
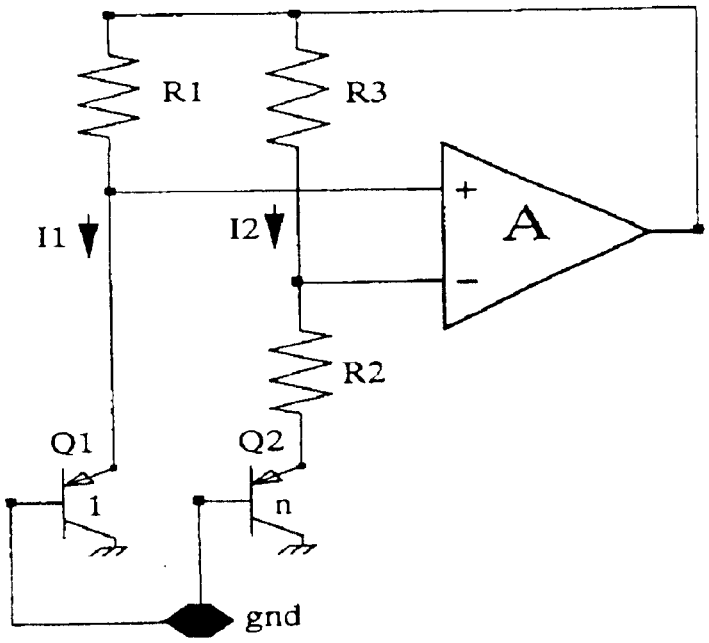
Fig.1 (Prior Art)
FIG. 1 is a schematic of a prior art implementation of a bandgap reference circuit.
Figure 2:
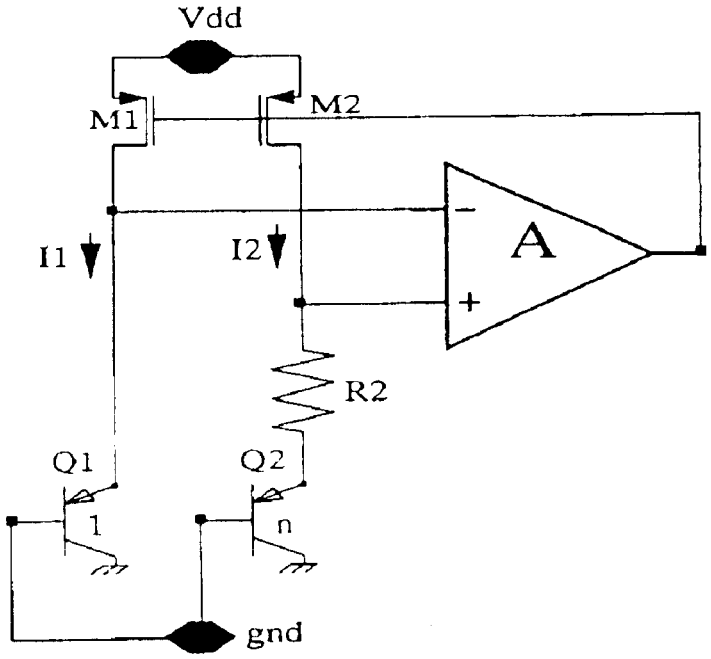
Fig.2 (Prior Art)
FIG. 2 is a schematic of a further prior art implementation.
Figure 3:
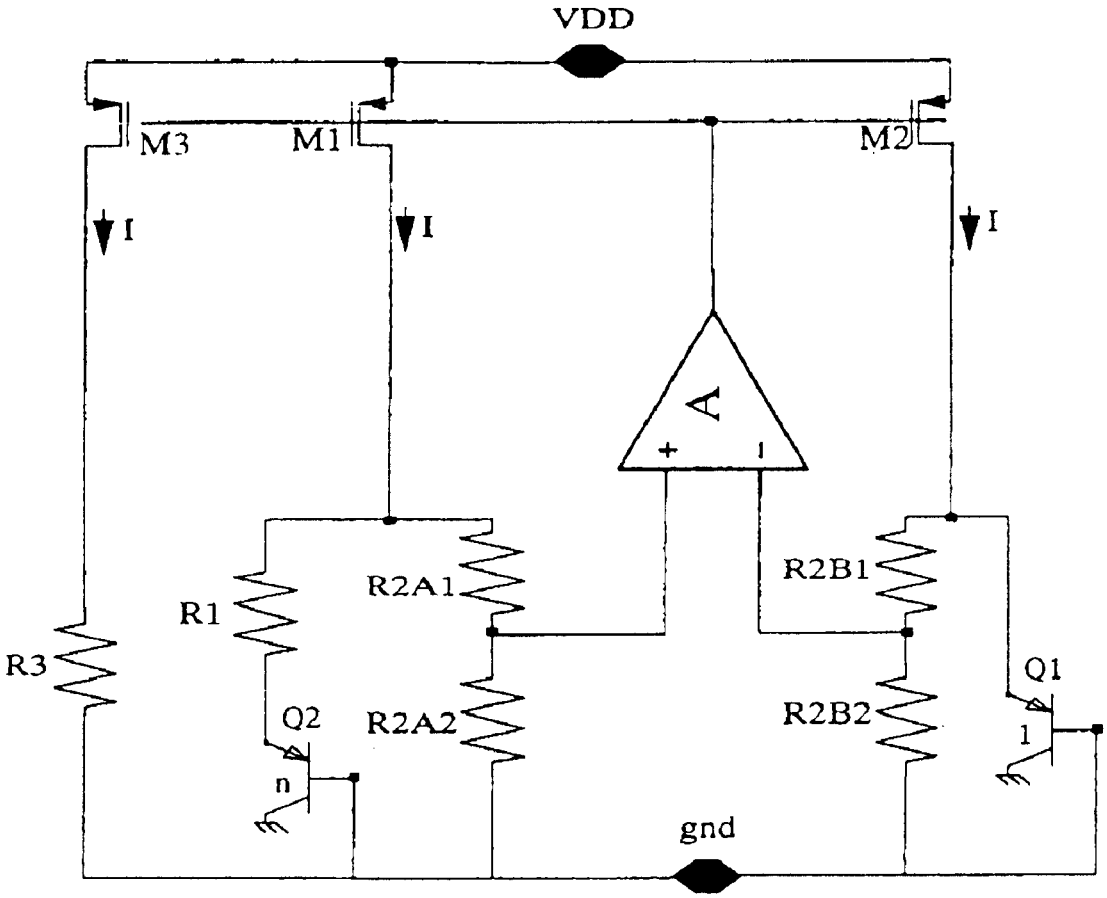
Fig.3 (Prior Art)
FIG. 3 is a schematic of a further example of a prior art implementation.

It will be appreciated that the configurations of FIG. 4 and FIG. 5 have further advantages to the circuitry of FIGS. 1 and 2. One such advantage is related to the supply current and silicon area required to develop a specific DeltaVbe. It will be appreciated that it is advantageous to generate a large DeltaVbe since this voltage along with the associated errors is to be reflected in the reference voltage by amplification. In the embodiments of FIGS. 1 and 2, DeltaVbe can be enlarged by either taking more silicon area for Q2 or by taking more current into the emitter of Q1. In the embodiments of the present invention, for the same R2, it is possible to increase DeltaVbe by reducing I2. The effect of this technique is such that the increment can be provided using less power for larger DeltaVbe. This advantage can also be used in order to reduce silicon area.

One further advantage of the configuration of FIG. 4 is that the two loops around the amplifier are negative feedback loops making the circuit more stable. If the voltage at the non-inverting input is, due to various reasons, increased as compared to the inverting input, than the amplifier's output is high. As a result, the currents through M1 to M4 are reduced and the non-inverting input voltage is reduced. If the inverting input voltage is increased than the amplifier's output goes low thereby forcing more current through M1 to M4. As current I2 is increased the voltage drop over R1 is also increased and the inverting input voltage is decreased.

FIG. 6 includes all of the same components as those of FIG. 5, with the addition of two further PMOS transistors M7 and M8, and two extra bipolar transistors, Q4 and Q5. Transistor Q1 is arranged in a transistor stack with transistor Q1, with the base of Q1 now coupled to the emitter of Q4 and having the same emitter area as Q1. The emitter of Q4 is also coupled to drain of the PMOS device M7. Similarly, the base of Q2 is now connected to the emitter of Q5, Q5 also having the same emitter area as Q2. The emitter of Q5 is coupled to the drain of PMOS M8. The bases of Q4 and Q5 are tied to ground. The sources of M7 and M8 are connected to VDD as expected.

As is usual with bandgap voltage reference circuits, the reference voltage is generated by adding a base-emitter voltage to a $\Delta V_{BE}$ generated by a pair of transistors. According to the implementation of the present invention as shown in FIG. 6, however, the amplifier input common mode range is lowered by an amount of $\Delta V_{BE}$. This has specific application in scenarios such as when the amplifier input-pair are a set of PMOS transistors and the reference voltage requires low voltage supply and/or extreme conditions such as those resultant from a temperature and process spread. The use of four bipolar transistors (two being stacked with a high current density and two with a lower current density) makes implementation easier due to the larger $\Delta V_{BE}$ created as compared to a non-stack arrangement.

For a given power dissipation and an input bias current the noise is about 5 times less than for an p-channel pair compared to an equivalent n-channel input pair. This implementation of stacked bipolar transistors and p-channel input pairs however has problems in scenarios of extreme conditions as the available headroom is quite small. As a result, the circuitry of FIG. 6 provides for a reduction n the amplifier input voltage.

Therefore the circuit of a preferred implementation of the present invention as provided for in FIG. 1 includes four transistors Q1, Q2, Q4, and Q5 which are biased at a PTAT current. Transistors Q1 and Q4 are provided with a large emitter area and are operated at a lower current density than transistors Q2 and Q5 which have a unitary emitter area and are operated at a high current density. It will be appreciated that as a result o)f this difference that a different $V_{BE}$ is established across them and the resultant difference $\Delta V_{BE}$ appears across resistor R1. This voltage is proportional to absolute temperature (PTAT).

Amplifier A operates On a manner which forces the voltage at the inputs "+" and "−" to be equal. This results in the $V_{BE}$ on Q1 and Q4 appearing at both inputs for FIG. 6. The $\Delta V_{BE}$ appears across R1. A feedback current, which is a PTAT current, is generated via feedback by the amplifier A and is mirrored by the current mirror M1 to M8. The current mirror M2 forces a voltage drop $\Delta V_{BE}$ across R1.

Assuming that the feedback current I is a PTAT current (i.e. Proportional to Absolute Temperature), Q1, Q5 are unity emitter area bipolar transistors, and Q1 and Q4 have an emitter area n times larger that of Q2 and Q5, it can be shown that the only difference is that of the common input voltage for the amplifier A of FIG. 6 is less than the corresponding voltage of the Amplifier A in FIG. 1 by an amount $\Delta V_{BE}$. This voltage difference provides a headroom gain for the circuitry of FIG. 6. It will be appreciated that additional compensation feedback R-C circuitry may be incorporated into the circuit of FIG. 6 so as to provide compensation for the two loops which are present in the circuit.

Figure 7:
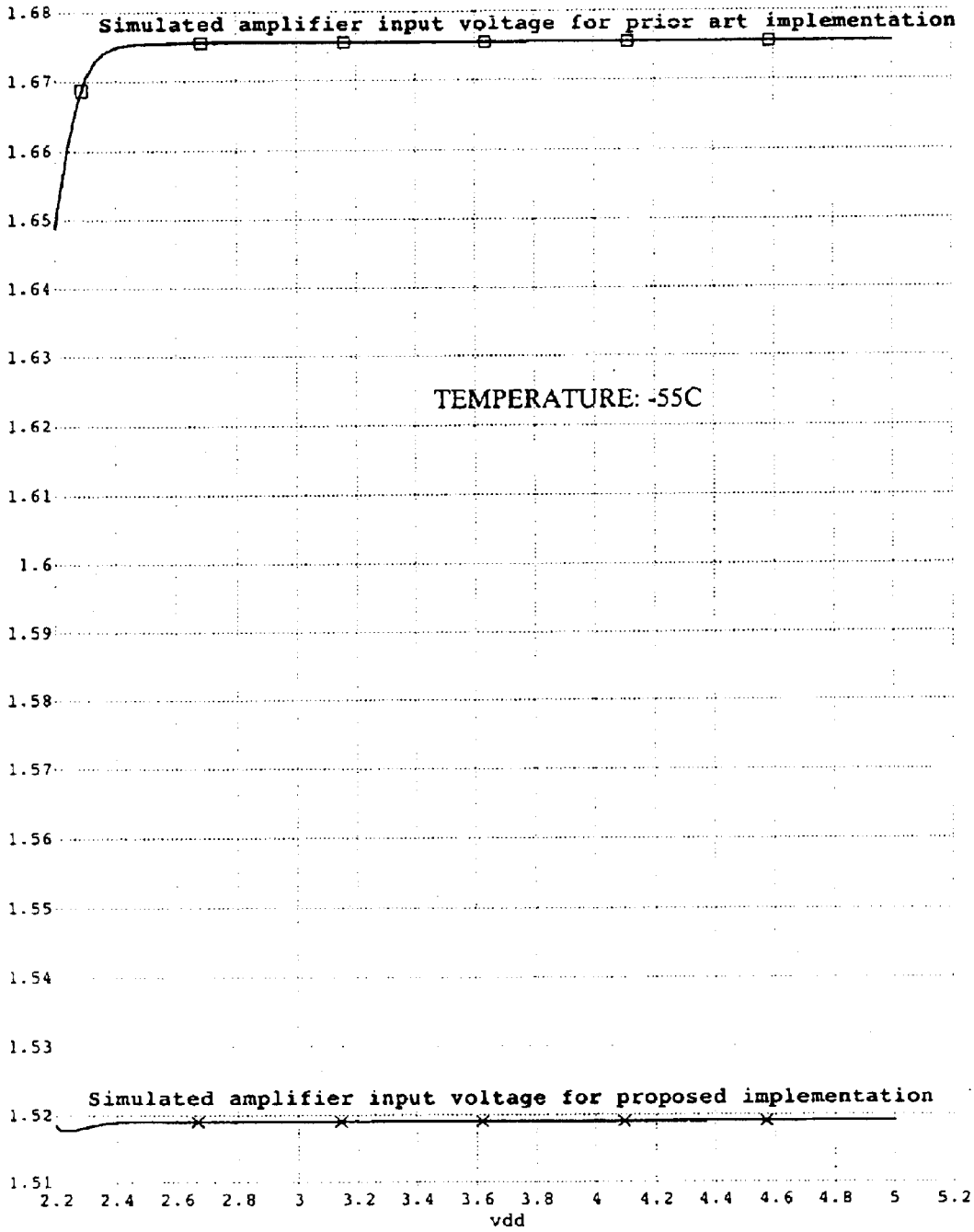
FIG. 7 is a simulation graph comparing the input voltages at an amplifier in a circuit according to the prior art and at the same amplifier in a circuit according to the present invention, at −55 degrees Celsius.

FIG. 7 shows the amplifier input voltages for an implementation according to the present invention as compared to the values resultant in a prior art implementation for the worst case conditions, being −55 degrees Celsius. It will be appreciated that for this specific example the input voltage of the amplifier A in the circuit of the present invention is about 150 mV less than the equivalent input voltage at the transistor in the prior art implementations.

Figure 8:
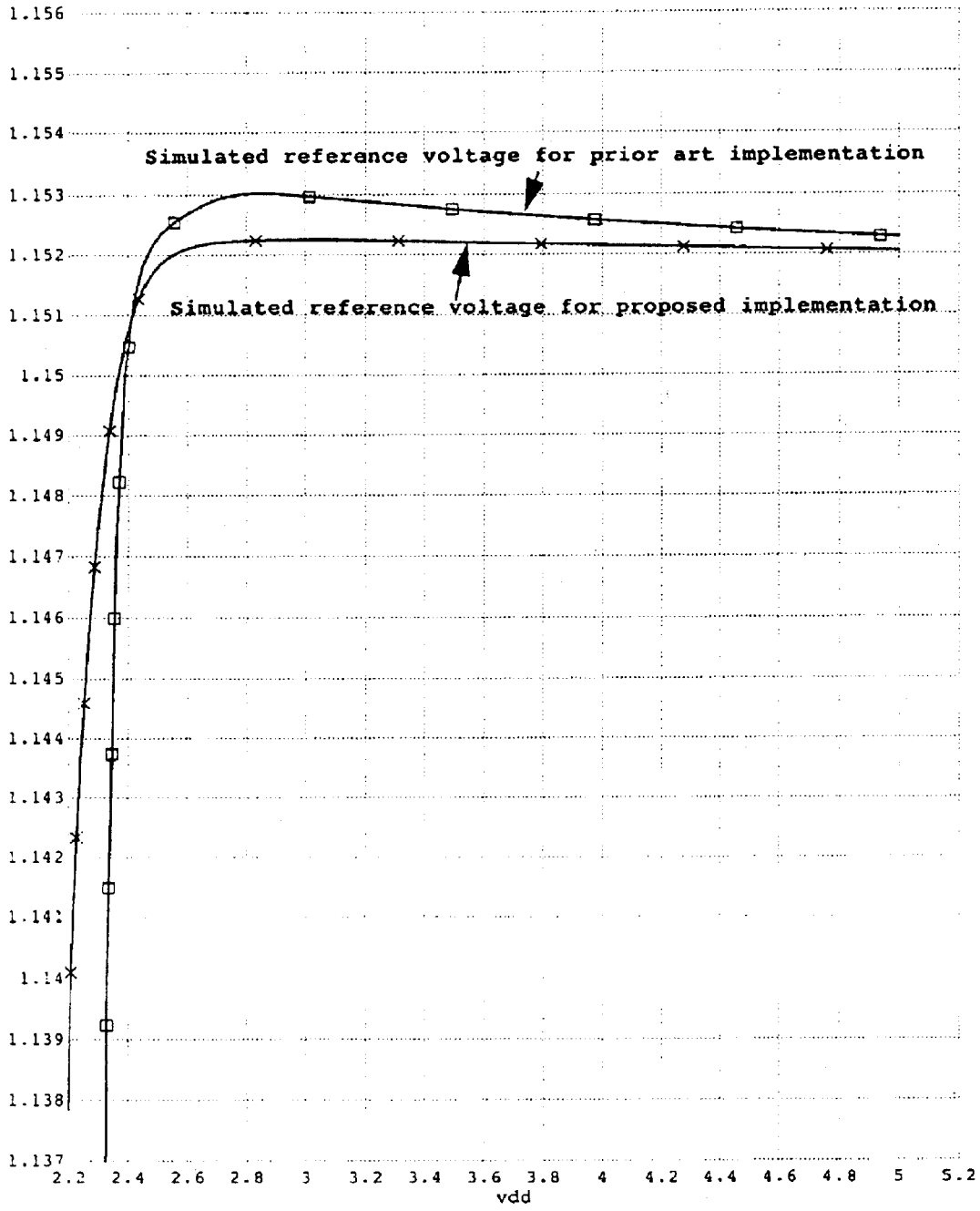
FIG. 8 is a comparison of simulated reference voltage outputs according to the prior art and the present invention.

As a result of this amplifier input difference, the reference voltage provided by the circuit of the present invention starts to drop at lower voltages than that of the prior art implementations. This improvement in headroom for the worst condition (−55 degrees Celsius) is shown in FIG. 8.

Figure 9:
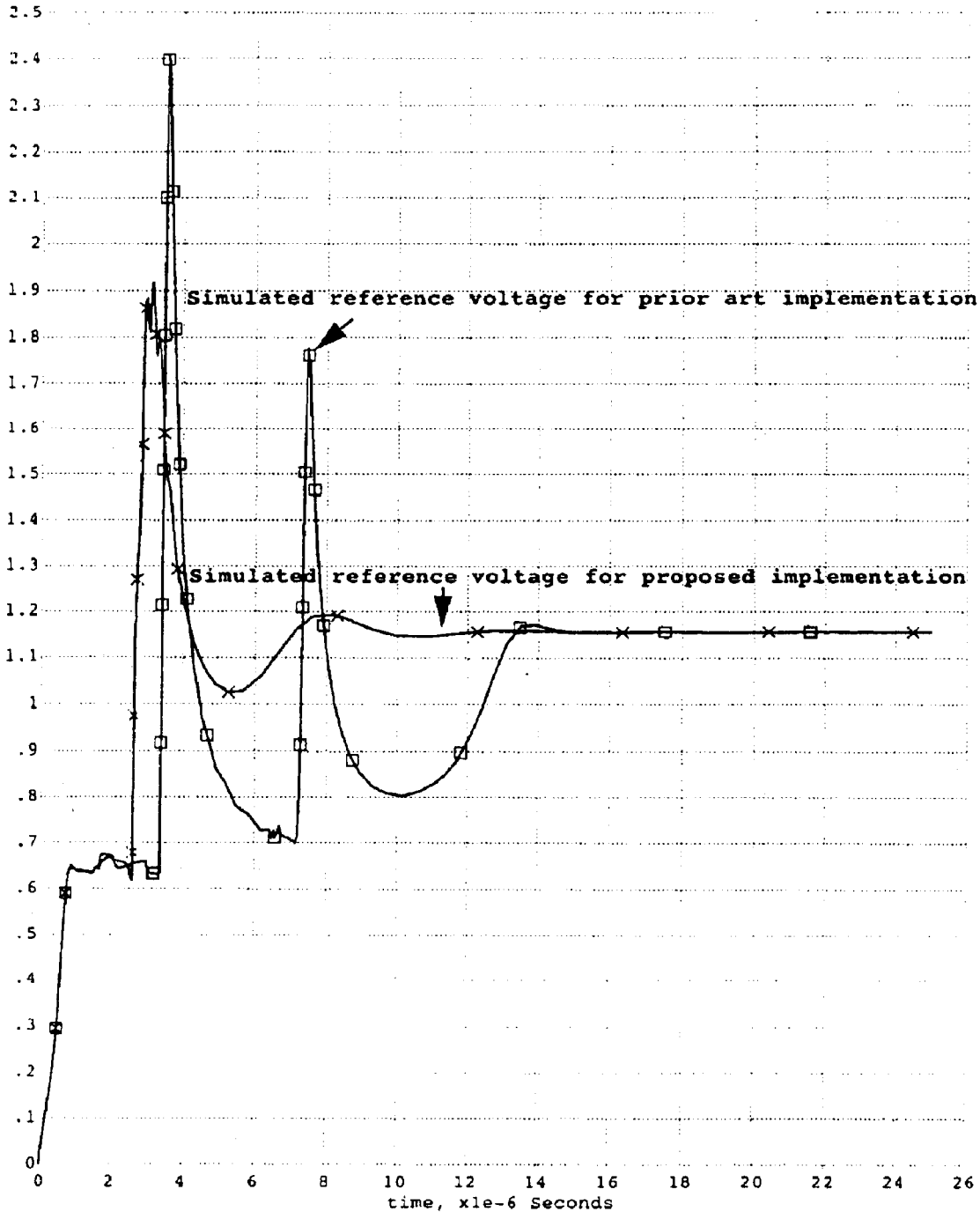
FIG. 9 shows a comparison of simulated start up times for a circuit according to the present invention and that according to the prior art.

FIG. 9 shows the start up time for circuits according to the present invention as compared to that of the prior art circuitry of FIGS. 1 and 2 for the same amplifier, from which it will be seen that the circuits of the present invention have less oscillation rings and a shorter start up time when compared to the prior art. At the same time the total area required for frequency compensation is about ½ times the area required for the prior art, and it will be appreciated that the circuitry of the present invention starts faster.

It will be appreciated that the circuitry of the present invention is advantageous over prior art implementation in many ways including the manner in which the start up is quicker, it can operate at lower supply voltages with lower headroom, it has better PSRR and as it requires smaller compensation capacitors, a lower die area is required.

There has been described herein a bandgap voltage reference circuit with improved headroom over the prior art. It will be appreciated by those skilled in the art that modifications may be made without departing from the spirit and scope of the present invention. Accordingly it is not intended to limit the invention in any way except as may be necessary in view of the appended claims.

The words "comprises/comprising" and the words "having/including" when used herein with reference to the present invention are used to specify the presence of stated features, integers, steps or components but does not preclude the presence or addition of one or more other features, integers, steps, components or groups thereof.

What is claimed is:

1. An improved headroom bandgap reference voltage circuit, the headroom being defined by a difference between the power supply voltage for the circuit and the reference voltage provided by the circuit, the circuit comprising:

an operational amplifier having an inverting and a non-inverting input node, the input nodes providing a common input voltage to the operational amplifier, the operational amplifier having an output being coupled to a voltage reference node, and wherein the inverting and non-inverting input nodes are coupled to a first and a second transistor respectively, the transistors having different current densities, with one transistor operating at a first current density and the other transistor operating at a second higher current density, the transistors being configured such that the common input voltage of the operational amplifier is provided by the base emitter voltage of the transistor operating at the first current density, thereby effecting a reduction of the common input voltage of the operational amplifier so as to reduce the operational headroom of the circuit.

2. A circuit according to claim 1, wherein the voltage at the voltage reference node is a combination of proportional to absolute temperature (i.e. PTAT) and complementary to absolute temperature (i.e. CTAT) voltages, the combination of the CTAT and PTAT voltages providing a compensatory effect on the reference voltage value so as to produce a stabilized bandgap voltage reference.

3. A circuit according to claim 2, further comprising a third transistor, the third transistor being coupled to the output of the operational amplifier and configured so as to provide a CTAT voltage.

4. A circuit according to claim 2, wherein an impedance load is coupled between the voltage reference node and ground, the PTAT voltage being generated by a coupling of a PTAT current generated at the output of the amplifier across the impedance element.

5. A circuit according to claim 4 wherein the output node of the operational amplifier is coupled to at least one current mirror, the current mirror mirroring the PTAT current generated at the output of the operational amplifier and coupling that current to one of the inputs of the operational amplifier.

6. A circuit according to claim 1 wherein the common input voltage of the operational amplifier is derived from the difference in base emitter voltages of the first and second transistors.

7. A circuit according to claim 6 further comprising a resistor coupled between one of the input nodes of the operational amplifier and the transistor operating at the higher current density, the voltage measured across the resistor being equivalent to the voltage difference between the base emitter voltages of the first and second transistors.

8. A circuit according to claim 7, wherein the reduction of the common input voltage of the operational amplifier is by an amount equal to the voltage difference between the first and second transistors produced across the resistor.

9. The circuit as claimed in claim 1 wherein a pair of transistors provided in a stack arrangement are coupled to each of the inputs of the amplifier, the stack arrangement being such as to provide a first pair of transistors operating at a lower current density than a second pair of transistors.

10. A bandgap reference voltage circuit having an operational amplifier with a first and a second transistor coupled to first and second inputs thereof, the first and second transistors having different current densities, the first transistor operating at a first current density and the second transistor operating at a second higher current density, the operational amplifier having a common input voltage, and wherein a resistor is provided between a first input of the operational amplifier and the second transistor, such that the voltage at the common input to the operational amplifier is lower than the base-emitter voltage of the second transistor by an amount substantially equivalent to the base-emitter voltage difference of the two transistors.

11. The circuit as claimed in claim 10 the output of the amplifier is coupled to a current mirror, the current mirror adapted to mirror a PTAT current provided at the output of the amplifier to one of the inputs of the amplifier.

12. A method of providing a voltage bandgap circuit with improved headroom, the method comprising the steps of:

providing an amplifier having first and second inputs and having a common input voltage, with transistor components coupled to the inputs, the transistor components being provided with different current densities, with a first transistor components operating at a first current density lower than the current density of the second transistor components, the transistor components being configured to generate a bandgap voltage at the common input voltage of the amplifier, effecting a reduction of the voltage applied to the common input by an amount substantially equivalent to a difference in base emitter voltages of the transistor components coupled to the inputs of the amplifier, the reduction being effected by the provision of a resistor between a first input of the amplifier and the second transistor components.

* * * * *

UNITED STATES PATENT AND TRADEMARK OFFICE

CERTIFICATE OF CORRECTION

PATENT NO. : 6,885,178 B2
DATED : April 26, 2005
INVENTOR(S) : Stefan Marinca

It is certified that error appears in the above-identified patent and that said Letters Patent is hereby corrected as shown below:

Column 10,
Line 3, after the word "claim 10," insert the word -- wherein --.

Signed and Sealed this

Twenty-second Day of November, 2005

JON W. DUDAS
*Director of the United States Patent and Trademark Office*